US005588451A

United States Patent [19]

Peters

[11] Patent Number: 5,588,451

[45] Date of Patent: Dec. 31, 1996

[54] HAIR RETAINER

[76] Inventor: Helen A. Peters, 2992 Paradise Dr., West Bend, Wis. 53095

[21] Appl. No.: 434,206

[22] Filed: May 2, 1995

[51] Int. Cl.[6] ..... A45D 8/04; A45D 8/34; A45D 8/36

[52] U.S. Cl. ..... 132/273; 132/245; 132/282; 132/246; 132/268

[58] Field of Search ..... 132/273, 246, 132/275, 245, 55, 282, 226, 268, 264

[56] References Cited

U.S. PATENT DOCUMENTS

| | | | |
|---|---|---|---|
| 1,743,695 | 1/1930 | Tubbs | 132/226 |
| 1,889,227 | 11/1932 | Sterling | 132/226 |
| 1,895,653 | 1/1933 | Fisher | 132/268 |
| 2,490,285 | 12/1949 | Smith . | |
| 2,669,239 | 2/1954 | Smith | 132/48 |
| 2,783,763 | 3/1957 | King | 132/268 |
| 4,284,091 | 8/1981 | Ehmann | 132/268 |
| 5,309,928 | 5/1994 | Longoria | 132/268 |

*Primary Examiner*—Gene Mancene
*Assistant Examiner*—Pedro Philogene
*Attorney, Agent, or Firm*—Quarles & Brady

[57] ABSTRACT

A hair retainer and method for using the retainer, the retainer including an elongate rigid member and at least one protuberance extending radially outwardly from the member. The protuberance forms a helical rib around the member having surfaces that oppose motion in one direction along the length of the member more than in the opposite direction. The retainer can be inserted into a hair style by rotating the retainer and applying force in a direction along the length of the retainer.

15 Claims, 3 Drawing Sheets

FIG. 1
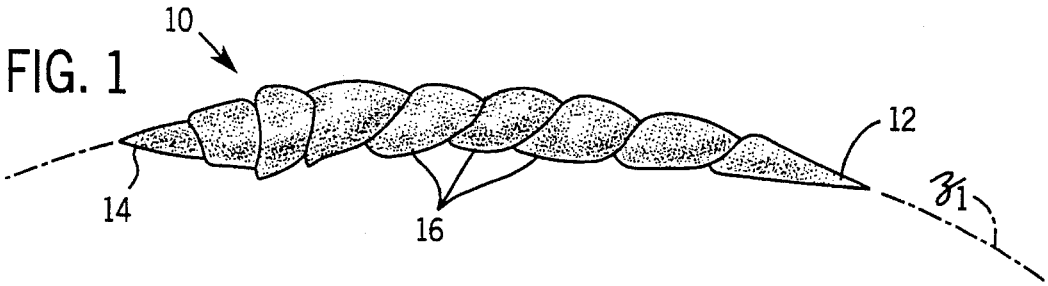
FIG. 2
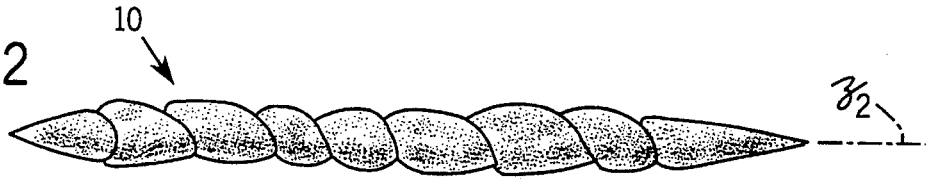
FIG. 3
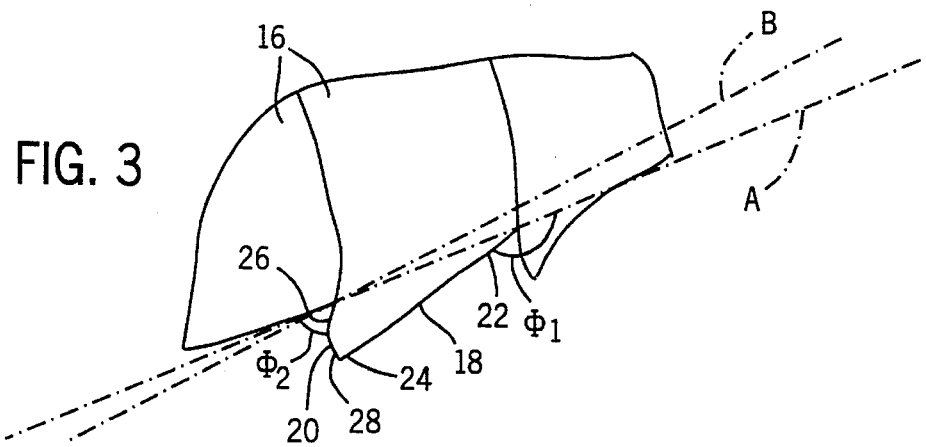
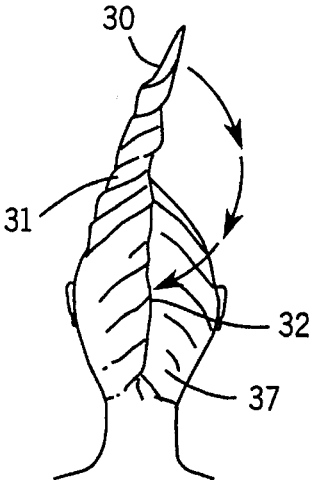
FIG. 4(a)
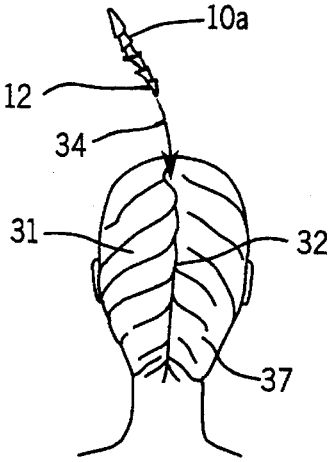
FIG. 4(b)
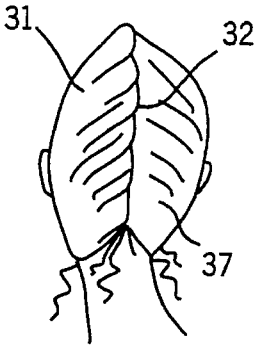
FIG. 4(c)

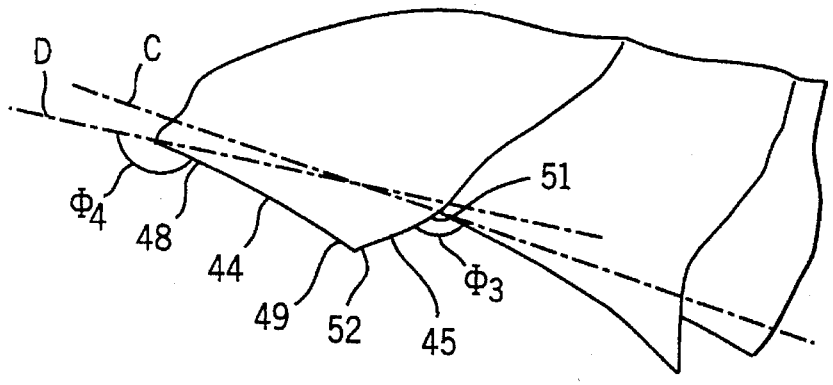
FIG. 8
FIG. 9
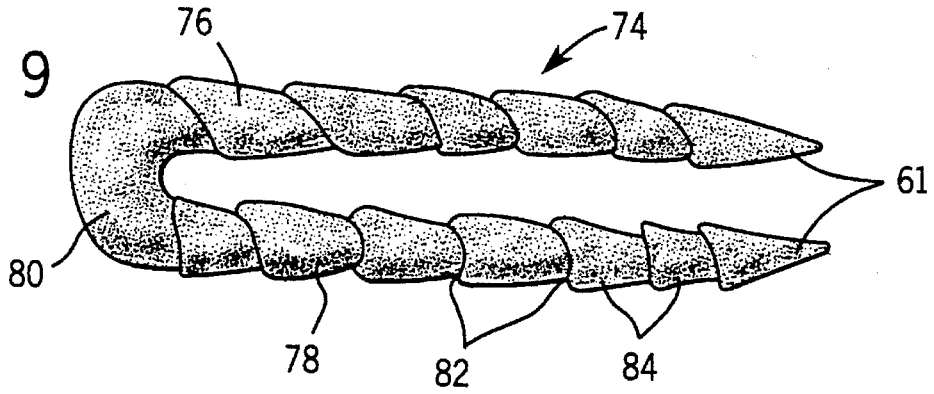
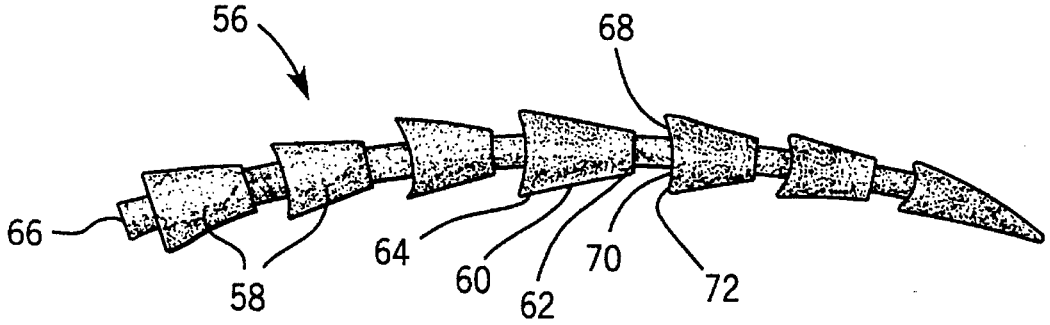
FIG. 10

HAIR RETAINER

FIELD OF THE INVENTION

The present invention relates to hair retainers and more particularly to a hair retainer which is nearly invisible when installed, is easy to use, and is remarkably effective.

DESCRIPTION OF THE ART

Throughout history people have been devising different means for changing hair styles to accentuate and or manage hair. These efforts have spawned chemical solutions such as sprays, cremes, and gels, methods such as perming and blow drying, and a whole host of apparati that can be used together or separately. While each solution devised is suitable for certain uses and has certain advantages, each also has its shortcomings.

Chemical and methodical styling solutions are advantageous because they are invisible (i.e. the hair appears to be naturally styled in a chosen form). In addition, these solutions can generally achieve any style where sufficient hair is provided. However, where hair is long or thick and chemical solutions alone are used to style, large amounts of chemicals are often required. Typically, styles controlled using chemicals are not easily changeable, a change requiring a washing, drying, and restyling, all of which is time consuming and labor intensive. In addition, excessive use of chemicals can damage both hair and the environment. Methodical solutions such as perming and blow drying are also time consuming, produce styles that are difficult to modify, and can damage hair when used excessively.

Some hair retainer apparati overcome the problems associated with chemical and methodical solutions. For example, virtually all retainer apparati are environmentally friendly and do not damage hair when used. In addition, some relatively "bulky" retainer apparati such as combs, barrettes, rubber bands, bows, hair nets, and scarfs are easy to install and remove so that hair style can be changed quickly.

Nevertheless, retainer apparati of this type are not particularly advantageous where it is desirable to produce a natural looking style by seemingly invisible means (i.e. bulky apparati is difficult to hide when installed). In addition, retainer apparati of this type often cannot be used to easily achieve certain hair styles. For example, none of these apparati can be used to easily fashion either a "french twist" or a "side twist", both of which are extremely popular styles well known in the art. Moreover, where a user has fine textured or dry hair, combs or the like can easily dislodge from hair causing hair to shift from a desired style.

Other less substantial hair retainer apparati do overcome the limitations associated with the bulky apparati listed above. For example, when installed, hair or bobby pins are nearly invisible. In addition, these pins can be used to achieve various styles that cannot be achieved using the more visible apparati. Moreover, where a plurality of pins are used, the pins fortify a hair style allowing little movement and hence the individual pins only rarely become dislodged.

Unfortunately hair and bobby pins suffer from some of the same shortcomings associated with chemical and methodical styling methods. Generally, a single pin cannot maintain a typical hair style. Upon installation, a single pin, like a comb, will often become dislodged. Hence, to secure most hair styles, a plurality of pins are required. Because many pins are required to hold a style, the pin solution typically involves a time consuming and labor intensive protocol. For this same reason, it is relatively difficult to alter a hair style that is secured using pins. Moreover, because a plurality of pins are required and most pins are relatively small, it is easy to lose one or more pins from a set.

U.S. Pat. No. 2,490,285 which issued on Dec. 10, 1945, describes another hair retainer which was meant to overcome the shortcomings of pins, combs, and the like. To this end, the patent describes a flexible elastic member having a plurality of short adjacent teeth. The member and teeth are constructed of a wire or plastic strand. The teeth are formed by reversing the strand upon itself and twisting so as to provide an entwining helical strand. The helical strand supposedly helps retain the retainer in the hair after insertion because it increases the friction between an associated tooth and adjacent hair. The member can bend in virtually all directions so as to assume the shape of a desired style. Only one of these retainers is required to hold a style.

However, this retainer requires some manual dexterity in application to grip hair and maintain hair in a desired style. This retainer requires careful working into the hair in order to secure a style. Because the teeth are short, after installation, the teeth at the ends of the retainer can work free under the stress of moving hair despite the twisted nature of each tooth. Moreover, the effectiveness of this retainer primarily depends upon the fineness and flexibility of the material of construction for its characteristic pliability which limits its strength in use and its useful life.

Therefore, it would be advantageous to have a hair retainer that is easy to install, can secure a hair style after installation and is nearly or entirely invisible after installation.

SUMMARY OF THE INVENTION

The present invention includes a retainer for retaining a flock of hair adjacent underlying hair. The retainer comprises at least one elongate rigid member having a leading end and a following end and at least one protuberance extending radially outwardly from the member, the protuberance forming at least one helical screwlike thread winding around the member, whereby, the member is positionable in a secure hair retaining position by simultaneously pressing the leading end into a hair flock and underlying hair while twisting the member in the direction of the thread so as to screw the member into the flock and underlying hair.

Hence, a first object is to provide a hair retainer that can be invisible when in use. The retainer can be screwed into a hair style until it is fully embedded within the hair with little or no portion extending therefrom.

Another object is to provide a hair retainer that will not become easily dislodged without deliberate movement of the retainer. By providing the screw-like thread on the retainer, after insertion, the retainer cannot be easily removed without rotation, and rotation of the retainer would not be expected unless imparted by a user.

Preferably, the protuberance is defined by at least a first leading surface and a first following surface, the first leading surface located relatively closer to the leading end than the first following surface. The first leading surface has first proximal and first distal ends, the first proximal end located relatively closer to the leading end than the first distal end. The first leading surface slopes radially outwardly from the first proximal end to the first distal end so as to form a first angle between the first leading surface and a first line tangent to a portion of the member adjacent the first leading surface.

The first following surface has second proximal and second distal ends, the first following surface sloping radially inwardly from the second distal end to the second proximal end so as to form a second angle between the first following surface and a second line tangent to a portion of the member adjacent the first following surface. The first angle is of an obtuse degree and the second angle is of a lesser degree than the first.

By providing the helical screw-like protuberance defined by surfaces having different slopes, the protuberance can grip the hair during insertion and further eliminate movement of the retainer along its length without purposeful rotation.

To facilitate easy insertion, preferably the first angle is greater than 140 degrees and the leading end is pointed. To further ensure secure placement within a hair style either the following surface or the leading surface may be textured or the entire member and protuberance may be textured.

In a particularly preferred embodiment, the protuberance includes a leading portion located adjacent the leading end and defined by the first leading and following surfaces and a following portion located adjacent the following end. The following portion is defined by at least a second leading surface and a second following surface, the second leading surface located relatively closer to the leading end than the second following surface, the second leading surface having fourth proximal and fourth distal ends and the second following surface having third proximal and third distal ends, the third proximal end located relatively closer to the following end than the third distal end, the second following surface sloping radially outwardly from the third proximal end to the third distal end so as to form a third angle between the second following surface and a third line tangent to a portion of the member adjacent the second following surface, the second leading surface sloping radially inwardly from the fourth distal end to the fourth proximal end so as to form a fourth angle between the second leading surface and a fourth line tangent to a portion of the member adjacent the second leading surface. The third angle is of an obtuse degree and the fourth angle is of a lesser degree than the third.

When installed, the first following surface and second leading surface compress hair, the hair minimizing movement of the retainer in either direction along its length without purposeful rotation.

The present invention also includes a retainer for retaining a flock of hair wherein the retainer comprises at least one elongate rigid member having a leading end and a following end and at least one protuberance extending radially outwardly from the member. The protuberance is defined by at least a leading surface and a following surface, the leading surface located relatively closer to the leading end than the following surface, the leading surface having first proximal and first distal ends, the first proximal end located relatively closer to the leading end than the first distal end, the leading surface sloping radially outwardly from the first proximal end to the first distal end so as to form a first angle between the leading surface and a first line tangent to a portion of the member adjacent the leading surface, the following surface having second proximal and second distal ends, the following surface sloping radially inwardly from the second distal end to the second proximal end so as to form a second angle between the following surface and a second line tangent to a portion of the member adjacent the following surface. The first angle is of an obtuse degree and the second angle is of a lesser degree than the first.

Preferably the member forms an arc. Thus, another object is to provide a hair retainer that conforms to the general shape of a users head.

The invention further includes a method for inserting a hair retaining member, the method to be used with an elongate rigid hair retaining member having a leading end and a following end and a surface area therebetween, the surface area defining a helical screwlike rib which winds around the member. The method comprises the steps of placing the leading end of the retaining member within a flock of hair and simultaneously exerting a force on the following end of the member tending to drive the member into the flock while rotating the member in the direction of the screwlike rib so as to screw the member into the flock. Preferably the method is continued until the member is fully inserted into the flock.

The invention also includes a method for removing a hair retaining member from an inserted position within a flock of hair, the method to be used with an elongate rigid hair retaining member having a leading end and a following end and a surface area therebetween. The surface area defines a helical screwlike rib which winds around the member. The method comprises the steps of grasping the following end of the member and simultaneously pulling on the following end of the member in a direction out of the hair while rotating the member in a direction opposite the direction of the screwlike rib so as to unscrew the member from the flock.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

BRIEF DESCRIPTION OF THE DRAWINGS

FIG. 1 is a side elevational view of a hair retainer according to the present invention;

FIG. 2 is a top elevational view of the hair retainer shown in FIG. 1;

FIG. 3 is a blown-up view of a portion of the hair retainer shown in FIG. 1;

FIGS. 4(*a*)–4(*c*) illustrate installation of two hair retainers according to the present invention;

FIG. 8 is a blown up view of a portion of the hair retainer shown in FIG. 7;

FIG. 9 is a top elevational view of a fifth embodiment of a hair retainer according to the present invention; and FIG. 10 is a side elevational view of a fifth embodiment of the inventive hair retainer.

DETAILED DESCRIPTION OF THE PREFERRED EMBODIMENT

Figure 5:
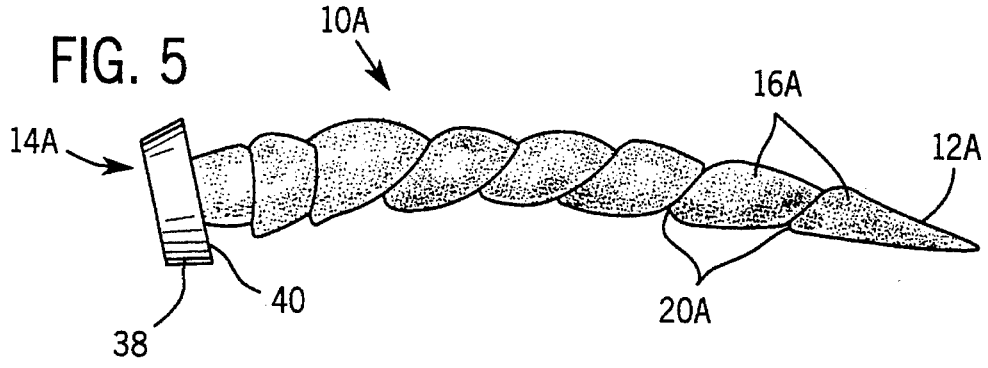
FIG. 5 is a side elevational view of a second embodiment of a hair retainer according to the present invention.

Referring to FIG. 1 a hair retainer 10 according to the present invention can be observed. The retainer 10 is generally formed as an oblong member having oppositely directed leading and following ends 12, 14 respectively. Preferably, the leading end 12 forms a point.

In a preferred embodiment, the surface of the retainer 10 between the leading and following ends 12, 14 forms a raised protuberance or rib 16 portion extending radially outwardly from the central portion of the retainer 10. The rib 16 wraps around the surface of the retainer 10 a plurality of times defining a helical screwlike thread pattern between the leading and following ends 12, 14.

Referring also to FIG. 3, the rib 16 is defined by first leading and first following surfaces 18, 20 respectively. The first leading surface 18 is nearer the leading end 12 than the first following surface 20. In the preferred embodiment shown, the first leading surface 18 is sloped radially outward from a proximal end 22 nearer the leading end 12 to a first distal end 24 relatively nearer the following end 14. The slope of the first leading surface 18 is relatively gradual, making a first angle $\Phi_1$ with a first line A tangent to a portion of the member 10 adjacent the first leading surface 18.

The first following surface 20 preferably extends radially inwardly from a second distal end 28 to a second proximal end 26. The slope of the first following surface 20 forms an angle $\Phi_2$ with a second line B which is tangent to a portion of the member 10 adjacent the first following surface 20.

Preferably, the first angle $\Phi_1$ is obtuse and the second angle $\Phi_2$ is of a lesser degree than the first. For example, the first angle $\Phi_1$ may be 140° whereas the lesser angle$\Phi_2$ may be 80°. Most preferably, the second angle $\Phi_2$ is less than 90° so that it can grip hair when installed.

Referring again to FIG. 1, when viewed from the side the retainer 10 defines an arc $\zeta_1$ which approximately mirrors the average curvature of a human head. Referring also to FIG. 2, when viewed from above, the retainer 10 is preferably formed about a single straight line $\zeta_2$.

The retainer 10 can be formed of any rigid or substantially rigid material including wood, metal, plastic or the like. The surface of the retainer 10 between the leading and following ends 12, 14 can be textured, smooth, or may have a combination of textured and smooth areas.

Referring now to FIGS. 4(*a*)–4(*c*), operation of the inventive hair retainer can best be understood by way of example. In FIGS. 4(*a*)–(*c*), two inventive retainers 10*a*, 10*b* are used together to secure a "french twist" hair style. In FIG. 4(*a*), hair is wound to form a helical mass 31 leaving underhair 37 adjacent the head. This can be most easily accomplished by turning the head upside down, gathering the hair and twisting the hair until the mass 31 is formed. At this point, a crease 32 should exist at the back of the head into which an end 30 of the hair mass 31 should be tucked. Next, referring also to FIG. 1, a first retainer 10*a* is grasped and the pointed leading end 12 is inserted into the back surface of the hair mass 31 along a line indicated by arrow 34, the arrow 34 passing through both the hair mass 31 as well as the underhair 37 adjacent the head.

With the leading end 12 buried in the hair mass 31, steady pressure is applied to the following end 14 in direction 34 tending to force the retainer 10*a* into the mass 31. While pressure is applied to the following end 14, the retainer 10*a* is rotated in an inserting direction. When rotated in the inserting direction, the helical rib 16 acts as a screw thread. Referring also to FIG. 3, as each portion of the rib 16 becomes buried in the hair, the leading and following surfaces 18, 20 come into contact with adjacent hair. Friction and simple butting between the hair and adjacent surfaces 18, 20 tends to limit movement of the retainer 10*a* in both direction 34 and in the opposite direction. While it is possible to force the retainer 10 in either direction along its length without rotating the retainer 10, such movement is impeded by the rib 16.

As the retainer 10*a* is rotated and becomes further embedded in the hair, the following surfaces 20 of the rib 16 are placed further into the hair flock. After full insertion, the rib 16 portions near the leading end 12 are securely embedded in the underhair 37 adjacent the head. Rotation should be stopped once the following end 14 descends into the hair. If necessary, an additional partial twist can be imparted to the retainer to conform the general arc $\zeta_1$ of the retainer to the shape of the wearers head.

After full insertion, the hair mass 31 is released and the hair mass tends to pull away from the head. However, because portions of the rib 16 near the leading end 12 are embedded in the underhair 37, and other portions of the rib 16 adjacent the following end 10 are embedded in the hair mass 31, the rib 16 ties the hair mass 31 against the back part of the head and the hair mass 31 remains in the styled position until the retainer is deliberately removed.

To further secure the hair, a second (and perhaps third if desired) retainer 10 can be used in the same manner as the first retainer 10*a*. For best results, the second retainer should be installed in a different direction than the first and may extend from the underlying hair 37 adjacent the head into the helical hair mass 31. When the second retainer 10*b* is so positioned, the following surfaces 20 of the second retainer 10*b* near the leading end 12 are anchored in the hair mass 31 whereas the following surfaces 20 of the first retainer 10*a* near the leading end 12 are anchored in the underhair 37. As it is the following surface 20 that makes the less obtuse angle $\Phi_2$ (see FIG. 3) it is the following surface that primarily responsible for the holding characteristic of the retainer, where two retainers are used, they should be used in this opposing orientation (i.e. a first retainer extending from the mass 31 into the underhair 37 and a second in the opposite direction).

After the retainers are installed, the hair style should be completely secured. To further ensure a secure style, a small amount of hair spray can be used. Under normal use, the retainers will not loosen or fall out of the style. To remove a retainer, the following end 14 is uncovered and grasped. By rotating the retainer 10 in the direction opposite the inserting direction, the retainer 10 "unscrews" from the hair. After a plurality of rotations the retainer can be freely removed.

While the different angles formed by the leading and following surfaces should in most cases suffice to limit movement of the retainer after it is installed, to further limit movement, the surface of the retainer or portions of the surface of the retainer can be specially textured to increase friction between the surface and adjacent hair after installation. For example, referring again to FIGS. 1 and 3, there are various surfaces on the retainer 10 that are primarily used for insertion and other surfaces that are primarily used for securing purposes. For example, the leading surfaces 20 near the leading end 12 of the retainer 10 are primarily used for insertion purposes and encounter most of the friction during insertion. To facilitate easy insertion, these surfaces can be left smooth and untextured which limits friction with hair during a rotational insertion motion. Similarly, upon removing the retainer from an installed position, the following surfaces 20 near the following end 14 of the retainer 10 encounter excessive friction. To limit this friction and facilitate easy removal, these surfaces may be left smooth and untextured.

On the other hand, after a retainer 10 is fully inserted into a hair flock, the following surfaces 20 near the leading end 12 and the leading surfaces 18 near the following end 14 cooperate together to hold and secure hair in a desired position. To increase the friction between adjacent hair after insertion, the leading surfaces 18 near the following end 14 and the following surfaces 20 near the leading end 12 can be textured. In the alternative, all of the surfaces of the retainer 10 can be textured to ensure limited movement of the retainer after installation.

Figure 6:
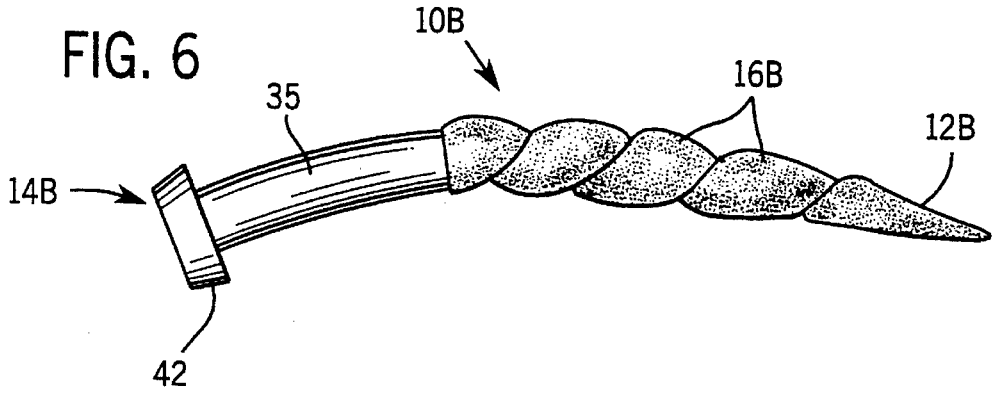
FIG. 6 is a side elevational view of a third embodiment of a hair retainer according to the present invention.
Figure 7:
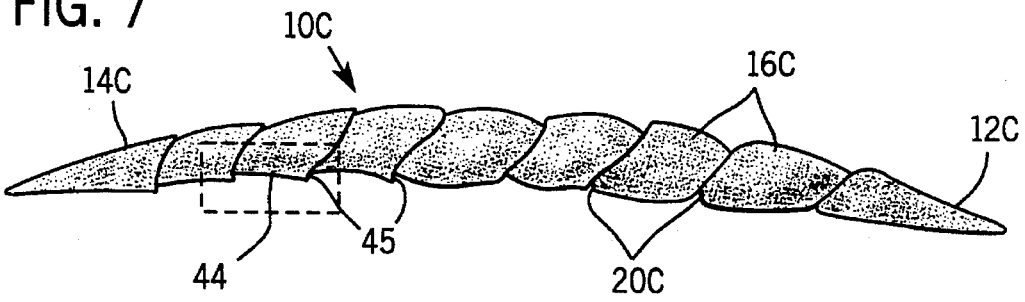
FIG. 7 is a side elevational view of a fourth embodiment of a hair retainer according to the present invention.

Referring now to FIGS. 5, 6, and 7, three additional embodiments of the inventive retainer can be observed. Each of these embodiments has many features that are identical to those described with respect to the first embodiment, and therefore, identical features will be identified by the same numbers used to identify features in the first embodiment followed by a capital letter A, B, or C indicating the second, third, or fourth preferred embodiments respectively.

Referring specifically to FIG. 5, a second embodiment of the preferred invention can be observed. This embodiment is identical to the first embodiment in all aspects except for one. In this embodiment, the retainer 10A includes a radially outwardly extending flange 38 that extends normal to the length of the retainer 10A at its following end 14A. This embodiment functions in the same manner as the first except for near the end of an insertion at which point a shelf portion 40 of the flange 38 contacts and ties adjacent hair into a secured position. With this embodiment, hair between following surface 20A of the rib 16A and the shelf 40 is compressed during the final turns of a retainer 10A during insertion. This compression further secures the retainer within the hair and further locks the hair in styled position.

Referring to FIG. 6, a third embodiment of the inventive retainer 10B can be observed. This embodiment is identical to the second embodiment shown in FIG. 5 in all aspects except for one. In this embodiment, between a flange 42 at the following end 14B and the portion of the rib 16B at the leading end 12B, there exists a sheer or smooth, ribless portion 35. This embodiment works in substantially the same manner as the second embodiment but embodies the recognition that it might not be necessary to have a rib extending the entire length of the retainer 10B for securing purposes.

Referring now to FIG. 7, a fourth embodiment of the inventive retainer 10C can be observed. In this embodiment, a leading half of the retainer 10C adjacent the leading end 12C is identical in all aspects to the retainer described with respect to the first embodiment. However, the following portion of this retainer 10C is different in that the following and leading surfaces 44, 45 respectively, have different slopes that tend to hinder movement of the retainer 10C in the inserting direction and facilitate movement in the removing direction. Referring also to FIG. 8, with this embodiment the portion of the rib 16C near the following end is defined by second leading and second following surfaces 45, 44 respectively. The second following surface 44 is nearer the following end 14C than the second leading surface 45. In the preferred embodiment shown, the second following surface 44 is sloped radially outward from a third proximal end 48 nearer the following end 14C to a third distal end 49 relatively nearer the leading end 12C. The slope of the second following surface 44, like the first leading surface 18 in FIG. 3, is relative gradual, making a third angle $\Phi_3$ with a third line D tangent to a portion of the member 10C adjacent the second following surface 44.

The second leading surface 45 preferably extends radially inwardly from a fourth proximal end 51 to a fourth distal end 52. The slope of the second leading surface 45 forms a fourth angle $\Phi_4$ with a fourth line D which is tangent to a portion of the member 10C adjacent the second leading surface 45. In this embodiment, the third angle $\Phi_3$ is obtuse and the fourth angle $\Phi_4$ is of a lesser degree than the third. Preferably the third angle $\Phi_3$ is greater than 140° and the fourth angle is less than 90°.

With this design, the retainer 10C is inserted and removed in exactly the same manner as the first embodiment. However, referring to FIGS. 7, 8, and 4(*b*), during the second half of rotations required to install the retainer 10C, as the following end 14C portion of the rib 16C encounters the hair, the second leading surfaces 45 make contact with the hair and impedes movement of the hair to an extreme degree in the direction opposite the inserting direction 34 of the retainer 10C. With this embodiment, when fully inserted, the first following surfaces 20 (see FIG. 3) are embedded and in full contact with the underlying hair 37 adjacent the head thus impeding movement of the retainer in the removing direction without rotation. In addition, referring to FIG. 8, the second leading surfaces 45 at the following end 14C are embedded in the hair mass 31 and impede relative motion between adjacent hairs and the following end 14C of the retainer.

Importantly, the angles $\Phi_1$, $\Phi_2$, $\Phi_3$, and $\Phi_4$ can change along the length of the retainer 10 and the surfaces 18, 20, 44, 45 can each have some degree of curvature.

It should be understood that the methods and apparati described above are only exemplary and do not limit the scope of the invention, and that various modifications could be made by those skilled in the art that may fall under the scope of the invention. For example, referring to FIG. 10, the scope of the present invention includes retainers having impeding means other than a helical rib 16. Thus, instead of having a helical rib, a retainer 56 may include a plurality of cylindrical ribs 58 equispaced along the length of the retainer 56, each rib formed by a leading surface 60 extending radially outwardly from a proximal end 62 to a distal end 64 wherein the distal end 64 is relatively closer to a following end 66 of the retainer 56 and a following surface 68 which extends radially outwardly in a direction from a proximal end 70 to a distal end 72 wherein the slope of the leading surface defines an angle with a line tangent to the length of the retainer that is greater than a similar angle defined by the following surface 68. With this type of retainer, instead of screwing the retainer 56 into the hair, the retainer 56 could Just be pushed into the hair. To remove the retainer 56, the retainer could be pushed through the other side of the hair where possible or carefully worked out of the hair against the impeding following surfaces 68.

To this end, where the retaining characteristic is only a function of the different angles formed by the leading and following surfaces, referring to FIG. 9, a fifth embodiment of the retainer may include a "U" shaped member 74 having two extensions 76, 78 and a connector 80 therebetween. Protuberances define differently angled following 82 and leading surfaces 84 on each of the extensions 76, 78.

With this embodiment, installation is performed by inserting the member 74 like a bobby-pin, directly into the hair. However, this retainer works better than a typical bobby-pin because of the differently angled leading and following surfaces 82, 84 respectively.

Moreover, the present invention also contemplates a retainer having a helical rib wherein the cross section of the helical rib is symmetrical (i.e. the slope defined by the leading and following surfaces are complimentary). In this embodiment, where the slopes defined by the leading and following surfaces are both steep, movement of the retainer in an inserting direction or a removing direction would be limited to that allowed by rotation of the retainer.

In order to apprise the public of the various embodiments that may fall within the scope of the invention the following claims are made:

I claim:

1. A retainer for retaining a flock of hair, the retainer comprising:

at least one elongate rigid member having a pointed leading end and a following end; and at least one protuberance extending radially outwardly from the member, the protuberance is defined by at least a leading surface and a following surface, the leading surface located relatively closer to the leading end than the following surface, the leading surface having first proximal and first distal ends, the first proximal end located relatively closer to the leading end than the first distal end, the leading surface sloping radially outwardly from the first proximal end to the first distal end so as to form a first angle between the leading surface and a first line tangent to a portion of the member adjacent the leading surface, the following surface having second proximal and second distal ends, the following surface sloping radially inwardly from the second distal end to the second proximal end so as to form a second angle between the following surface and a second line tangent to a portion of the member adjacent the following surface, the first angle is of an obtuse degree and the second angle is of a lesser degree than the first.

2. The retainer as recited in claim 1 wherein the at least one protuberance includes a plurality of protuberances.

3. The retainer as recited in claim 2 wherein the plurality of protuberances are spaced along the length of the member.

4. The retainer as recited in claim 1 wherein the protuberance forms an annular ring around the member.

5. The retainer as recited in claim 2 wherein the plurality of protuberances are positioned so as to form at least one helical thread winding around the member, and the member is positionable in a secure hair retaining position by simultaneously pressing the leading end into a hair flock while twisting the member in the direction of the thread so as to screw the member into the flock.

6. The retainer as recited in claim 5 wherein the thread extends from one end of the member to the other.

7. The retainer as recited in claim 1 wherein the member forms an arc wherein the leading and following ends are substantially facing in opposite directions.

8. The retainer as recited in claim 1 wherein a flange extends radially outwardly from the following end.

9. The retainer as recited in claim 1 wherein the leading and following surfaces are textured and the following surface texture is relatively courser than the leading surface texture.

10. The retainer in claim 1 wherein the first angle is greater than 140 degrees.

11. The retainer as recited in claim 1 wherein the protuberance includes a leading portion located adjacent the leading end and defined by the first leading and following surfaces and a following portion located adjacent the following end, the following portion defined by at least a second leading surface and a second following surface, the second leading surface located relatively closer to the leading end than the second following surface, the second leading surface having fourth proximal and fourth distal ends and the second following surface having third proximal and third distal ends, the third proximal end located relatively closer to the following end than the third distal end, the second following surface sloping radially outwardly from the third proximal end to the third distal end so as to form a third angle between the second following surface and a third line tangent to a portion of the member adjacent the second following surface, the second leading surface sloping radially inwardly from the fourth distal end to the fourth proximal end so as to form a fourth angle between the second leading surface and a fourth line tangent to a portion of the member adjacent the second leading surface, the third angle is of an obtuse degree and the fourth angle is of a lesser degree than the third.

12. The retainer as recited in claim 1 including at least two elongated rigid members and a connector between the following ends of each elongated rigid member.

13. A method for inserting a hair retaining member, the method to be used with an elongate rigid hair retaining member having a leading end and a following end and a surface area therebetween, the surface area defining a helical rib which winds around the member, the method comprising the steps of:

(a) placing the leading end of the retaining member within a flock of hair; and (b) simultaneously exerting a force on the following end of the member tending to drive the member into the flock;

(c) while rotating the member in the direction of the screwlike rib so as to screw the member into the flock.

14. The method as recited in claim 13 further including the step of repeating steps b and c until the member is fully inserted into the flock.

15. A method for removing a hair retaining member from an inserted position within a flock of hair, the method to be used with an elongate rigid hair retaining member having a leading end and a following end and a surface area therebetween, the surface area defining a helical rib which winds around the member, the method comprising the steps of:

(a) grasping the following end of the member; and (b) simultaneously pulling on the following end of the member in a direction out of the hair;

(c) while rotating the member in a direction opposite the direction of the screwlike rib so as to unscrew the member out of the flock.

* * * * *